United States Patent [19]

Sugimoto et al.

[11] Patent Number: 4,545,746

[45] Date of Patent: Oct. 8, 1985

[54] ROTATION-PREVENTING DEVICE FOR AN ORBITING PISTON-TYPE FLUID DISPLACEMENT

[75] Inventors: Kazuo Sugimoto; Shigemi Shimizu; Kiyoshi Terauchi, all of Gunma, Japan

[73] Assignee: Sanden Corporation, Gunma, Japan

[21] Appl. No.: 589,753

[22] Filed: Mar. 15, 1984

[30] Foreign Application Priority Data

Mar. 15, 1983 [JP] Japan ..... 58-36344[U]

[51] Int. Cl.[4] ..... F01C 1/04; F16B 11/00

[52] U.S. Cl. ..... 418/55; 403/274

[58] Field of Search ..... 418/55; 464/103; 403/274, 284

[56] References Cited

U.S. PATENT DOCUMENTS

| | | | |
|---|---|---|---|
| 801,182 | 10/1905 | Creux | 418/55 |
| 847,069 | 3/1907 | Hawkins . | |
| 1,342,936 | 6/1920 | Barber | 403/274 X |
| 1,906,142 | 4/1933 | Ekelof | 418/55 |
| 4,160,629 | 7/1979 | Hidden et al. | 418/55 |
| 4,259,043 | 3/1981 | Hidden et al. | 418/55 |
| 4,303,379 | 12/1981 | Hiraga et al. | 418/55 |
| 4,406,600 | 9/1983 | Terauchi et al. | 418/55 |
| 4,457,674 | 7/1984 | Kawano et al. | 418/55 |
| 4,457,676 | 7/1984 | Hiraga | 418/55 |
| 4,468,181 | 8/1984 | Sakamoto | 418/55 |
| 4,472,120 | 9/1984 | McCullough | 418/55 |
| 4,492,543 | 1/1985 | Iimori et al. | 418/55 |

FOREIGN PATENT DOCUMENTS

| | | | |
|---|---|---|---|
| 1960216 | 6/1971 | Fed. Rep. of Germany | 464/103 |
| 1539373 | 1/1979 | United Kingdom | 403/274 |

*Primary Examiner*—John J. Vrablik
*Assistant Examiner*—Theodore W. Olds
*Attorney, Agent, or Firm*—Banner, Birch, McKie & Beckett

[57] ABSTRACT

A rotation-preventing/thrust-bearing device for use in an orbiting-member fluid displacement apparatus is disclosed. The rotation-preventing/thrust-bearing device includes a discrete fixed portion, a discrete orbital portion and bearing elements. The fixed portion includes a fixed race and ring placed in a groove in an inner surface of the housing. The fixed race and ring are attached to the housing by pins, and the inner peripheral edge of the groove is caulked to the fixed ring. The orbital portion includes an orbital race and ring placed in a groove in an end plate of the orbiting member. The orbital race and ring are attached to the end plate of the orbiting member by pins, and the outer peripheral edge of the groove in the end plate is caulked to the orbital ring. A plurality of pockets are formed axially in the rings toward the respective races. The pockets of the rings face one another in generally aligned pairs. A bearing element is received in each aligned pair of pockets to prevent the rotation of the orbiting member by the bearing elements interacting with the orbital and fixed rings and to carry the axial thrust load from the orbiting member. The rotation of each ring, which is caused by protation-preventing operation, is prevented by both the pins and the caulked connection.

7 Claims, 8 Drawing Figures

ROTATION-PREVENTING DEVICE FOR AN ORBITING PISTON-TYPE FLUID DISPLACEMENT

TECHNICAL FIELD

This invention relates to a fluid displacement apparatus, and more particularly, to an improvement in a rotation-preventing/thrust-bearing device for an orbiting piston-type fluid displacement apparatus.

BACKGROUND OF THE INVENTION

There are several types of fluid displacement apparatus which utilize an orbiting piston or fluid displacement member. One type is a rotary machine as described in U.S. Pat. No. 1,906,142 to John Ekelof, which includes an annular eccentrically movable piston that acts within an annular cylinder having a radial traverse wall. One end wall of the cylinder is fixedly mounted and the other wall consists of a cover disk connected to the annular piston which is driven by a crank shaft. Another prior art fluid displacement apparatus of the orbiting piston type is a scroll-type apparatus as shown in U.S. Pat. No. 801,182 to Creux. Though the present invention is applicable to either type of fluid displacement apparatus (i.e., using either an annular piston or a scroll-type piston), the description will be made in connection with a scroll-type compressor.

U.S. Pat. No. 801,182 discloses a device that includes two scrolls, each having a circular end plate and a spiroidal or involute spiral element. These scrolls are maintained angularly and radially offset so that the spiral elements interfit to make a plurality of line contacts between their spiral curved surfaces to thereby define and seal off at least one pair of fluid pockets. The relative orbital motion of the two scrolls shifts the line contacts along the spiral curved surfaces and, as a result, the volume of the fluid pockets changes. Since the volume of fluid pockets increases or decreases dependent on the direction of the orbital motion, the scroll-type fluid displacement apparatus is applicable to compress, expand or pump fluids.

Generally, in a conventional scroll-type fluid displacement apparatus, one of the scrolls is fixed to a housing and the other scroll, which is an orbiting scroll, is supported on a crank pin of a drive shaft at a location eccentric of the drive shaft's axis to cause the orbital motion of the orbiting scroll. The scroll-type apparatus also includes a rotation-preventing device which prevents the rotation of the orbiting scroll to thereby maintain the two scrolls in a predetermined angular relationship during the operation of the apparatus.

Furthermore, since the orbiting scroll is supported on the crank pin in a cantilever manner, an axial slant of the orbiting scroll occurs. Axial slant also occurs because the movement of the orbiting scroll is not rotary motion around the center of the scroll, but orbiting motion caused by the eccentric movement of the crank pin driven by the rotation of the drive shaft. Several problems result from the occurrence of this axial slant including improper sealing of the line contacts, vibration of the apparatus during operation and noise caused by physical striking of the spiral elements. One simple and direct solution to these problems is the use of a thrust-bearing device for carrying the axial loads. Thus, scroll-type fluid displacement apparatus are usually provided with a thrust-bearing device within the housing.

One recent attempt to improve the rotation-preventing/thrust-bearing devices in scroll-type fluid displacement apparatus is described in U.S. Pat. Nos. 4,160,629 (Hidden et al.) and 4,259,043 (Hidden et al.), in which the rotation-preventing/thrust-bearing devices are integral with one another. The rotation-preventing/thrust-bearing device described in these U.S. Patents (see FIG. 7 of U.S. Pat. No. 4,259,043) includes one set of indentations formed on the end surface of the circular end plate of the orbiting scroll and a second set of indentations formed on the end surface of a fixed plate attached to the housing. A plurality of balls or spheres are placed between the indentations of both surfaces. All the indentations have the same cross-sectional configuration, and the center of all indentations formed on both end surfaces are located about circles having the same radius. As a result, the machining and fabrication of these indentations to the required accurate dimensions is very difficult and intricate.

With reference to FIGS. 1, 2, and 3, one solution to the above disadvantage will be described. FIG. 1 is a vertical sectional view of a scroll-type compressor, and FIG. 2 is an exploded perspective view of a rotation-preventing/thrust-bearing device used in the compressor. Rotation-preventing/thrust-bearing device 23' surrounds a boss 223' of an orbiting scroll 22' and includes an orbital portion, fixed portion and bearings, such as a plurality of balls. The fixed portion includes (1) an annular fixed race 231' having one end surface fitted against the axial end surface of an annular projection 112' of a front end plate 11', and (2) a fixed ring 232' fitted against the other axial end surface of fixed race 231'. Fixed race 231' and ring 232' are attached to the axial end surface of annular projection 112' by pins 233'. The orbital portion also includes (1) an annular orbital race 234' having one end surface fitted against the axial end surface of a circular end plate 221', and (2) an orbital ring 235' fitted against the other axial end surface of orbital race 234' to extend outwardly therefrom and cover the other axial end surface of orbital race 234'. A small clearance is maintained between the facing end surfaces of fixed ring 232' and orbital ring 235'. Orbital race 234' and orbital ring 235' are attached to the end surface of circular end plate 221' by pins 236'.

Fixed ring 232' and orbital ring 235' each have a plurality of holes or pockets **232*a'* and 235*a'* in the axial direction, the number of holes or pockets in each ring 232', 235' being equal. Bearing elements, such as balls or spheres 237', are placed between facing generally aligned pairs of pockets 232*a'*, 235*a'* of fixed and orbital rings 232', 235', with the rings 232', 235'** facing one another at a predetermined clearance.

With reference to FIG. 3, the operation of the rotation-preventing/thrust-bearing device 23' will be described. In FIG. 3, the center of orbital ring 235' is placed at the right side and the direction of rotation of the drive shaft is clockwise, as indicated by arrow A. When orbiting scroll 23' is driven by the rotation of the drive shaft, the center of orbiting ring 235' orbits about a circle of radius Ror (together with orbiting scroll 22'). However, a rotating force (i.e., moment), which is caused by the offset of the acting point of the reaction force of compression and the acting point of drive force, acts on orbiting scroll 22'. This reaction force tends to rotate orbiting scroll 22' in a clockwise direction about the center of orbital ring 235'. But as shown in FIG. 3, eighteen balls 237' are placed between the corresponding pockets **232*a'* and 235*a'* of rings 232'** and 235'. In the position shown in FIG. 3, the interaction between the nine balls 237' at the top of the rotation-preventing/thrust-bearing device 23' and the edges of the pockets 232a', 235a' prevents the rotation of orbiting scroll 22'. The magnitude of the rotation-preventing forces are shown as $Fc_1$–$Fc_5$ in FIG. 3.

In the construction, as described above, the rotation-preventing/thrust-bearing device 23' is made up of a pair of races and a pair of rings, with each race and ring formed separately. Therefore, the parts of the rotation-preventing/thrust-bearing device are easy to construct and the most suitable material for each part can be selected. However, each ring is attached by pins. The rotation-preventing force of the ring is thus transmitted to the attachment pins. Since the location at which the rotation-preventing force of the rings act on the respective attachment pins is spaced from the location at which the pins are attached to the orbiting scroll or housing, a moment is generated which acts on the pins. Therefore, stress is placed on the attachment pins and this stress is increased by impact load which occurs when the compressor is driven at high speed. Also, since the attachment pins receive the radial component and tangential component of rotation preventing force, precession of the pins is caused. As a result, the attachment pins tend to move toward an outer direction and come out the holes in which they are located.

SUMMARY OF THE INVENTION

It is a primary object of this invention to provide an improved rotation-preventing/thrust-bearing device for an orbiting member fluid displacement apparatus.

It is another object of this invention to provide an orbiting member fluid displacement apparatus which improves the endurance life of the apparatus and is simple to construct and manufacture.

An orbiting member fluid displacement apparatus according to this invention includes a housing. A fixed member is attached to the housing and has a first end plate from which a fixed fluid displacement member extends into the interior of the housing. An orbiting member has a second end plate from which an orbiting fluid displacement member extends. The fixed and orbiting fluid displacement members interfit at a radial offset to make a line contact to separate a fluid inlet from fluid outlet. A driving mechanism including a drive shaft, which is rotatably supported by the housing, is connected to the orbiting fluid displacement member to effect its orbital motion.

A rotation-preventing/thrust-bearing device is connected to the orbiting fluid displacement member for preventing the rotation of the orbiting fluid displacement member during orbital motion so that the fluid pocket changes volume during the orbital motion of the orbiting fluid displacement member.

The rotation-preventing/thrust-bearing device comprises an orbital portion, a fixed portion and a plurality of bearings, such as balls or spheres. The orbital portion includes an annular race and ring, both of which are formed separately. The race and ring of the orbital portion are placed within an annular groove formed on the end surface of the end plate opposite to the side from which the orbiting member extends and are fixed therein by pins. The ring of the orbital portion is attached to the end surface of the race to cover it and has a plurality of pockets formed in an axial direction toward the race. The outer peripheral edge of the groove in the orbiting fluid displacement member is caulked to secure the orbital ring on the orbiting fluid displacement member. The term "caulk" as used herein refers to tightening, in particular a joint formed by overlapping or abutting metal plates, by driving the edge of one plate into closer contact with the surface of the other or by driving the edges of abutting plates together. The fixed portion also includes a second annular race and ring, both of which are formed separately. The second race and ring are placed within an annular groove formed on the inner surface of the housing and are fixed therein by pins. The second ring is attached to the end surface of the second race to cover it and has a plurality of pockets formed in an axial direction toward the race. The inner peripheral edge of the groove in the housing is caulked to secure the second ring on the inner surface of the housing. A clearance is maintained between the rings, and the bearings are placed between facing generally aligned first and second pockets of the rings. The rotation of the orbiting member is thus prevented by the bearings, which are placed in the pockets of both rings. The rotation of the rings due to the rotation-preventing force acting on the rings is prevented by both the pins and the caulking connection.

Further objects, features, and other aspects of this invention will be understood from the following detailed description of preferred embodiments of this invention, referring to the annexed drawings.

DETAILED DESCRIPTION OF THE PREFERRED EMBODIMENTS

Figure 1:
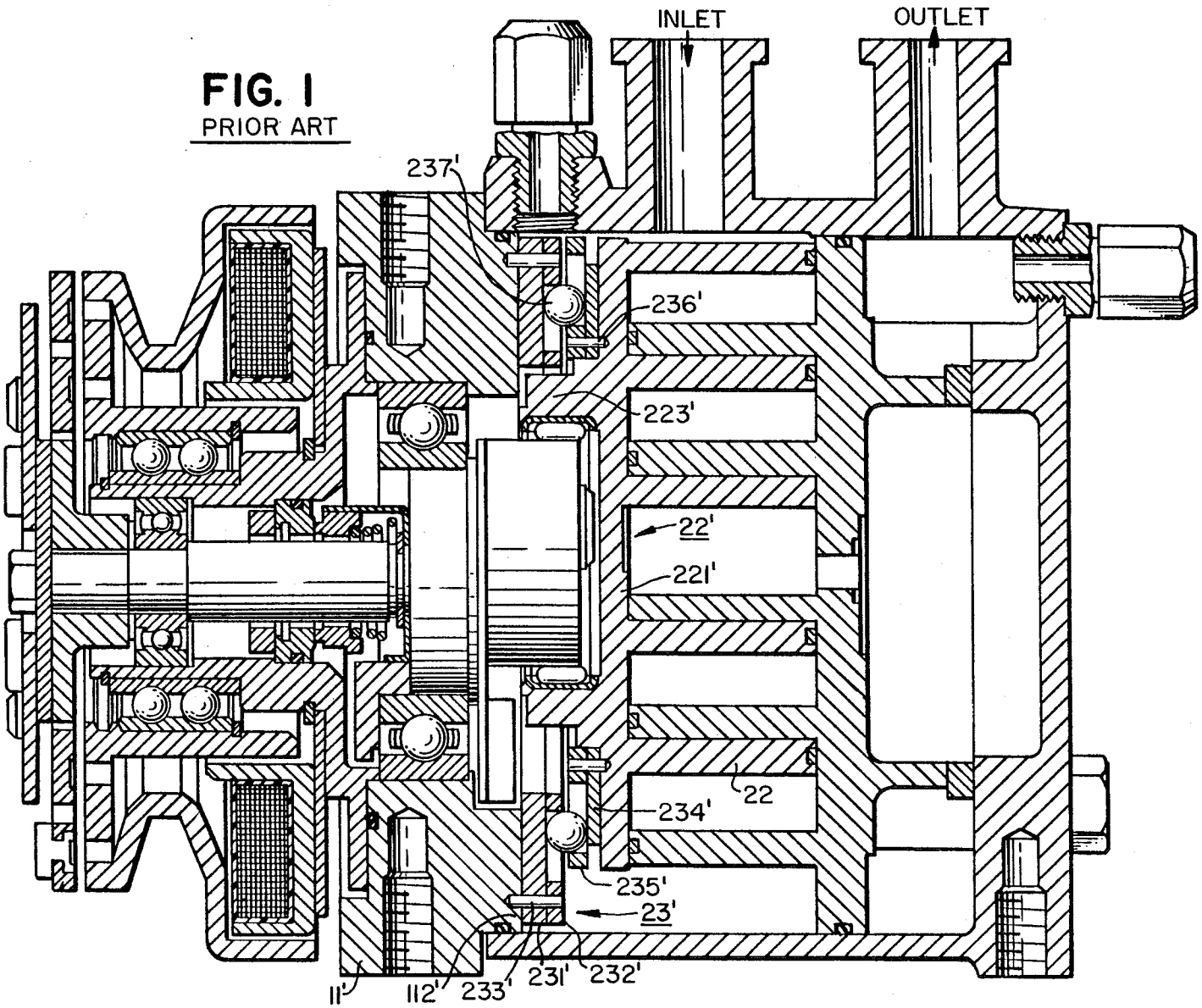
FIG. 1 PRIOR ART
FIG. 1 is a vertical sectional view of a part of a compressor illustrating a prior art construction of a rotation-preventing/thrust-bearing device.
Figure 2:
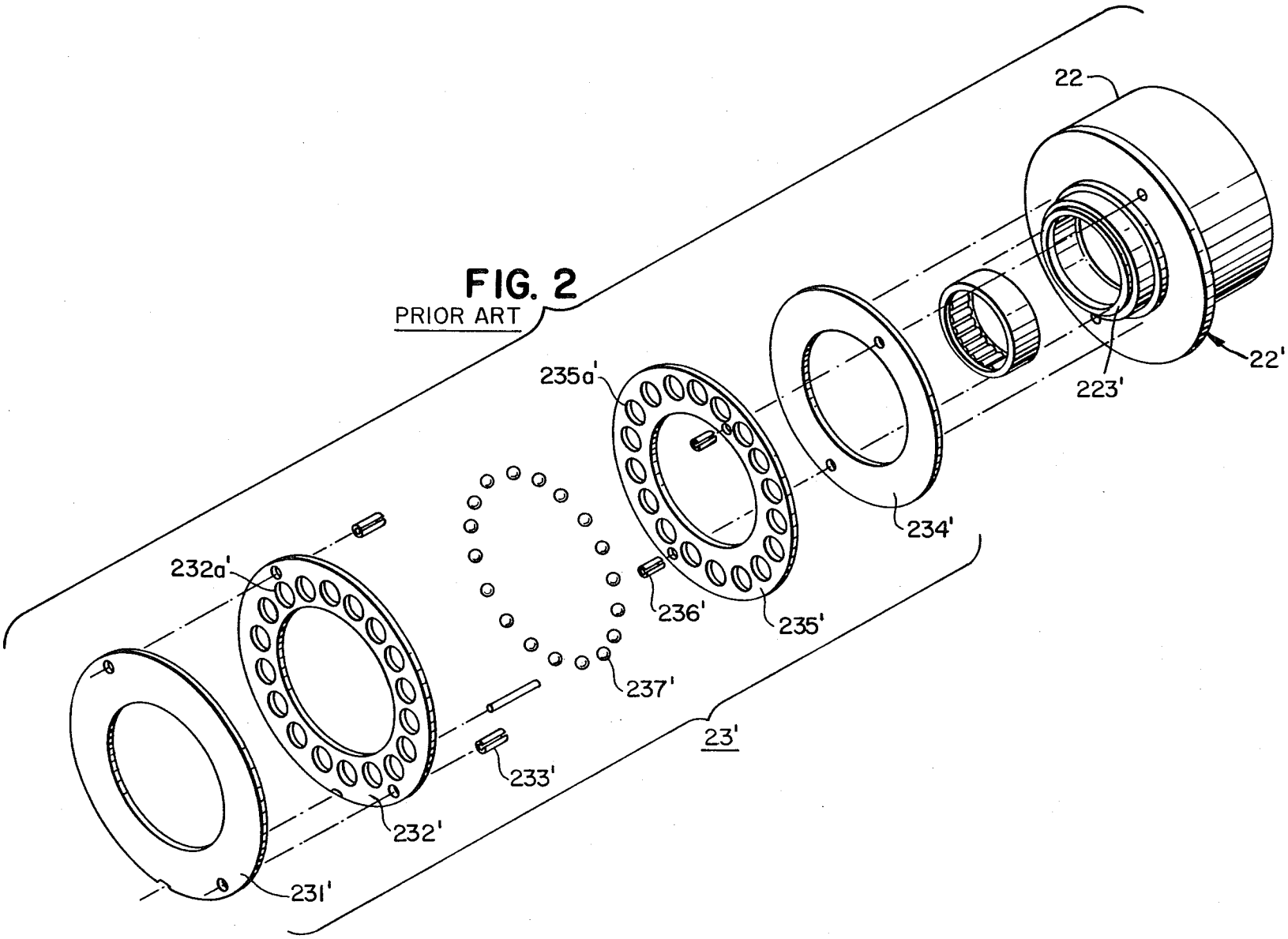
FIG. 2 PRIOR ART
FIG. 2 is a an exploded perspective view of the rotation-preventing/thrust-bearing device shown in FIG. 1.
Figure 3:
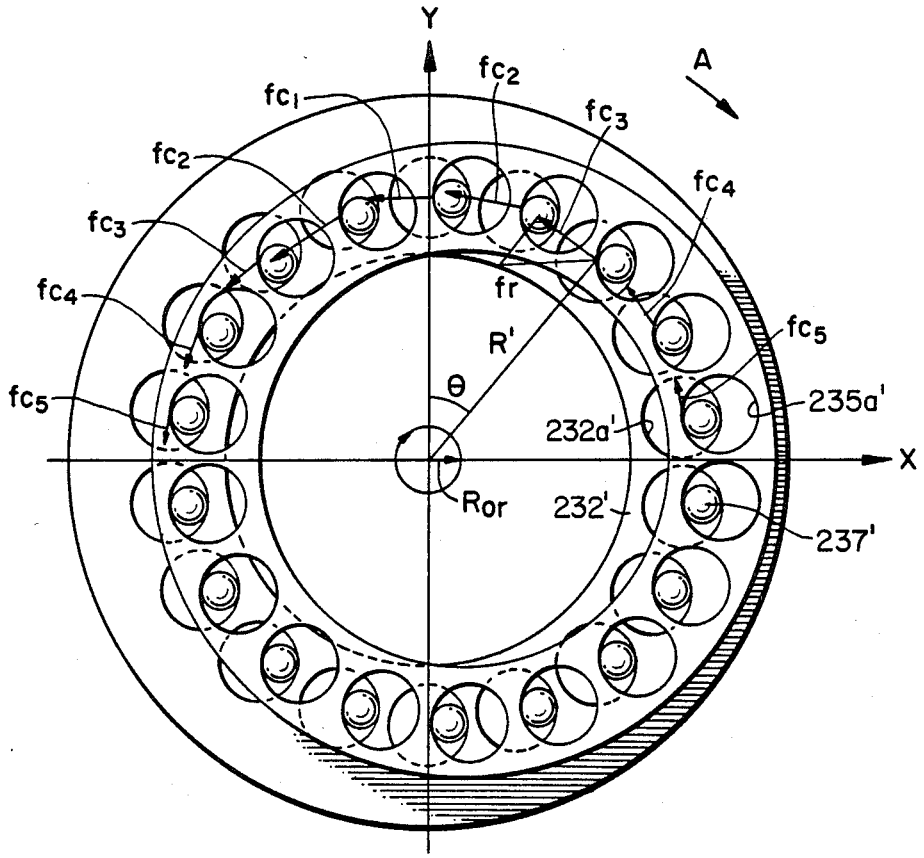
FIG. 3 PRIOR ART
FIG. 3 is a diagrammatic front view of the rotation-preventing/thrust-bearing device of FIG. 1 illustrating the manner by which rotation is prevented.
Figure 4:
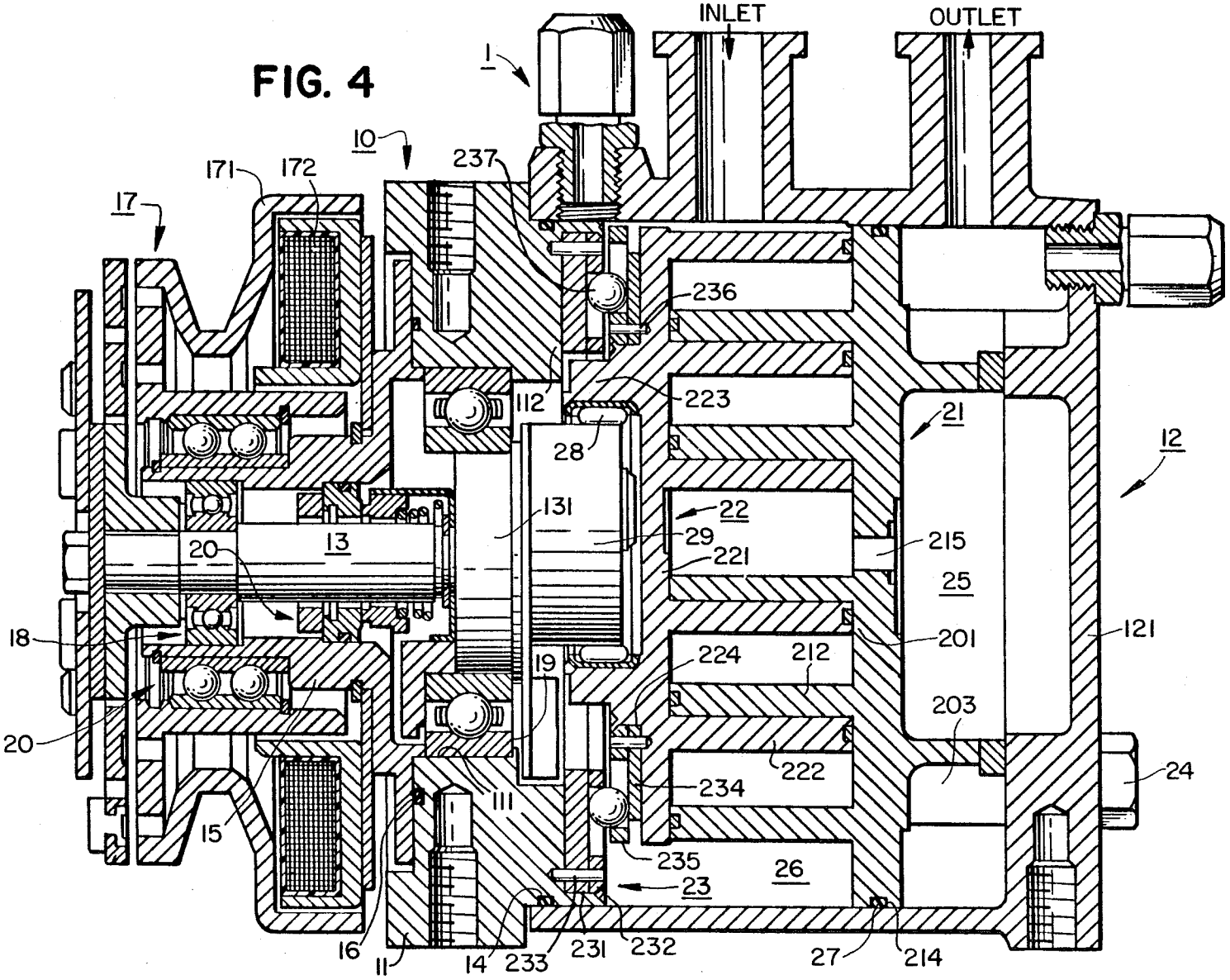
FIG. 4 is a vertical sectional view of a compressor unit according to one embodiment of this invention.
Figure 5:
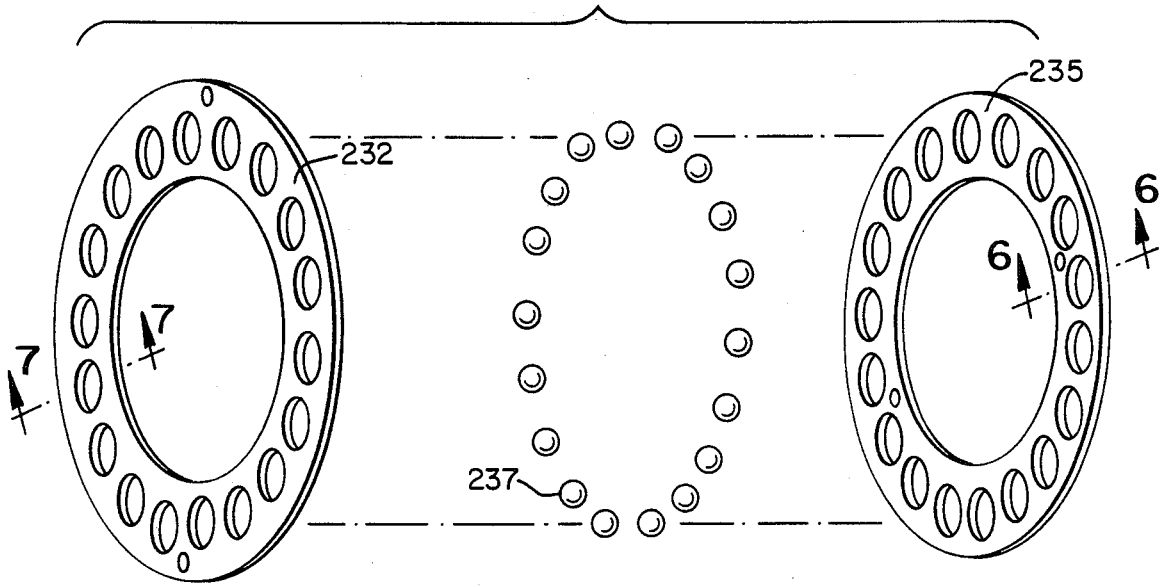
FIG. 5 is an exploded perspective view of a part of the rotation-preventing/thrust-bearing device of FIG. 4.

With reference to FIG. 4, an embodiment of a fluid displacement apparatus in accordance with the present invention, in particular a scroll-type refrigerant compressor unit 1 is shown. The compressor unit 1 includes a compressor housing 10 having a front end plate 11 and a cup-shaped casing 12, which is attached to an end surface of front end plate 11. An opening 111 is formed in the center of front end plate 11 for the penetration or passage of a drive shaft 13. An annular projection 112 faces cup-shaped casing 12 and is concentric with opening 111. An outer peripheral surface of annular projection 112 extends into an inner wall of the opening of cup-shaped casing 12. Cup-shaped casing 12 is fixed on the rear end surface of front end plate 11 by a fastening device, for example, bolts and nuts. The opening portion of cup-shaped casing 12 is thus covered by front end plate 11. An O-ring 14 is placed between the outer peripheral surface of annular projection 112 and the inner wall of cup-shaped casing 12.

Drive shaft 13 is rotatably supported by sleeve 15 through a bearing 18 located within the front end of sleeve 15. Drive shaft 13 has a disk-shaped rotor 131 at its inner end, which is rotatably supported by front end plate 11 through a bearing 19 located within opening 111 of front end plate 11. A shaft seal assembly 20 is coupled on drive shaft 13 within a shaft seal cavity of sleeve 15.

A magnetic clutch 17, which comprises a pulley 171, an electromagnetic coil 172 and an armature plate 173, is disposed on the outer peripheral portion of sleeve 15 through a bearing 20 and is fixed on the outer end portion of drive shaft 13 which extends from sleeve 15. Magnetic clutch 17 transmits rotation from an external power source to drive shaft 13.

A number of elements are located within the inner chamber of cup-shaped casing 12 including a fixed scroll 21, an orbiting scroll 22, a driving mechanism for orbiting scroll 22 and a rotation-preventing/thrust-bearing device 23 for orbiting scroll 22. The inner chamber of the cup-shaped casing is formed between the inner wall of cup-shaped casing 12 and the rear end surface of front end plate 11.

Fixed scroll 21 includes a circular end plate 211, a wrap or spiral element 212 affixed to or extending from one side surface of circular end plate 211, and a plurality of internally threaded bosses 213 axially projecting from the other end surface of circular end plate 211. An end surface of each boss 213 is seated on the inner surface of an end plate 121 of cup-shaped casing 12 and is fixed to end plate 121 by bolts 24. Scroll 21 is thus fixed within cup-shaped casing 12. Circular end plate 211 of fixed scroll 22 partitions the inner chamber of cup-shaped casing 12 into a rear chamber 25 having bosses 213, and a front chamber 26 in which spiral element 212 is located. A sealing element 27 is disposed within a circumferential groove 214 of circular end plate 211 for sealing the outer peripheral surface of circular end plate 211 and the inner wall of cup-shaped casing 12. A hole or discharge port 215 is formed through circular end plate 211 at a position near the center of spiral element 212. Hole 215 is connected between the fluid pocket at the spiral element's center and rear chamber 25.

Orbiting scroll 22, which is disposed in front chamber 26, includes a circular end plate 221 and a wrap or spiral element 222 affixed to or extending from one end surface of circular end plate 221. Spiral elements 212, 222 interfit at an angular offset of 180° and predetermined radial offset. At least one pair of sealed-off fluid pockets are thereby defined between the interfitting spiral elements. Orbiting scroll 22 is rotatably supported on a bushing 29 through a bearing 28. Bushing 29 is connected to a crank pin (not shown) projecting from the end surface of disk-shaped rotor 131 at an eccentric location. Orbiting scroll 22 is thus rotatably supported on the crank pin of drive shaft 13, and moved by the rotation of drive shaft 13. Furthermore, roation-preventing/thrust-bearing device 23 is placed between the inner end surface of front end plate 11 and end surface of circular end plate 221 of orbiting scroll 22, which faces the inner end surface of front end plate 11. As a result, orbiting scroll 22 orbits while maintaining its angular orientation relative to the fixed scroll 21, to thereby compress fluid passing through the compressor.

Figure 6:
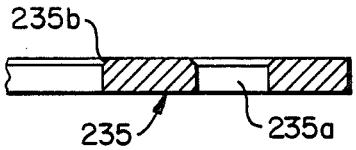
FIG. 6 is a cross-sectional view taken along line VI—VI in FIG. 5.
Figure 7:
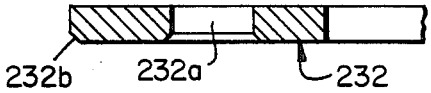
FIG. 7 is a cross-sectional view taken along line VII—VII in FIG. 5.

With reference to FIGS. 4–7, rotation-preventing/-thrust-bearing device 23 will be described. Device 23 surrounds boss 223 of orbiting scroll 22 and includes an orbital portion, a fixed portion and bearings, such as a plurality of balls. The fixed portion includes (1) an annular fixed race 231 which is placed within a groove 113 formed on the axial end surface of annular projection 112 of front end plate 11 and (2) a fixed ring 232 which is also placed within groove 113 and fitted against the axial end surface of fixed race 231 to cover the end surface of fixed race 231. Fixed race 231 and ring 232 are attached to the axial end surface of annular projection 112 by pins 233. In this construction, as shown in FIGS. 4 and 7, fixed ring 232 is closely fitted within groove 113 and has a beveled portion **232*b* at its outer peripheral edge. After the fixed portion is assembled, the inner peripheral edge of groove 113 is caulked so that the material of annular projection 112 is moved or deformed to overlap beveled portion 232*b* of fixed ring 232**.

The orbital portion also includes (1) an annular orbital race 234 which is placed within a groove 224 formed on the axial end surface of circular end plate 221 of orbiting scroll 22 and (2) an orbital ring 235 which is placed within groove 224 and fitted against the axial end surface of orbital race 234 to cover the end surface of orbital race 234. Orbital race 234 and ring 235 are attached to the axial end surface of circular end plate 221 by pins 236. In this construction, as shown in FIGS. 4 and 6, orbital ring 235 is closely fitted within groove 224 and has a beveled portion **235*b* at its inner peripheral edge. After the orbital portion is assembled on the orbiting scroll, the outer peripheral edge of groove 224 is caulked so that the material of circular end plate 221 is moved or deformed to overlap over beveled portion 235*b* of orbital ring 235. A small clearance is maintained between the facing end surfaces of fixed ring 232 and orbital ring 235**.

Fixed ring 232 and orbital ring 235 each have a plurality of holes or pockets **232*a* and 235*a* in the axial direction, the number of holes or pockets in each ring 232, 235 being equal. The holes or pockets 232*a* on fixed ring 232 correspond to or are a mirror image of the holes or pockets 235*a* on orbital ring 235 (i.e., each pair of facing pockets have the same size and pitch), and the radial distance of the pockets from the center of their respective rings 232 and 235 is the same (i.e., the centers of these pockets are located at the same distance from the center of the rings 232 and 235). Thus, if the centers of rings 232 and 235 were aligned, each pair of holes or pockets 232*a*, 235*a* would be in register with one another. In the assembled condition, fixed ring 232 and orbital ring 235 face one another with a predetermined clearance and with each pair of facing pockets 232*a* and 235*a* offset from one another. One of the bearing elements, such as balls 237, is placed in each pair of pockets 232*a* and 235*a* and is in contact with an edge of pocket 232*a* and with the opposite edge of pocket 235*a*. Therefore, the rotation of orbiting scroll 22 is prevented by balls 237, which interact with the edge of facing pockets 232*a*, 235*a*, while the angular relationship between fixed scroll 22 and orbiting scroll 23 is maintained. Also, the axial thrust load from orbiting scroll 22 which is caused by the reaction force of the compressed fluid, is carried by fixed race 231, orbital race 234 and balls 237**.

In this type of rotation-preventing/thrust-bearing device, each ring is secured to the end surface of the front end plate or orbiting scroll by both pins and a caulked connection. Since the radial force, which acts on the rings and tends to rotate the rings during the operation of the compressor, is absorbed by the caulked connection, the rotation-preventing force of rings acting on the pins is reduced. Therefore, the stress placed on the pins is reduced and the tendency of the pins to come out of the holes is prevented.

Figure 8:
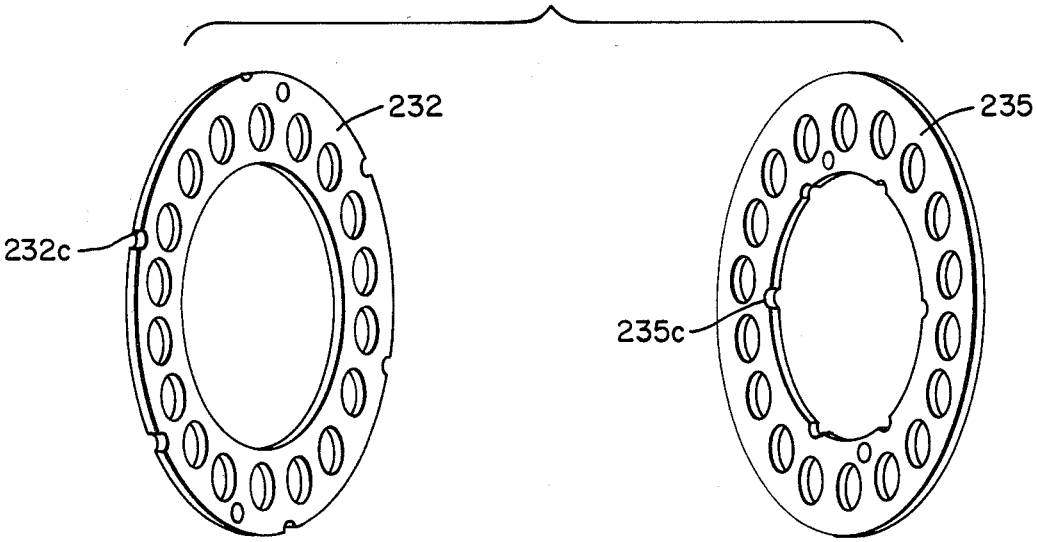
FIG. 8 is an exploded perspective view of the orbital and fixed rings of a rotation-preventing/thrust-bearing device according to another embodiment of this invention.

With reference to FIG. 8, another embodiment of this invention is shown, illustrating a modification of the construction for affixing the rings. In this embodiment fixed ring 232 and orbital ring 235 each have a plurality of cut-out portions 232*c* and 235*c* at their outer peripheral surface or inner peripheral surface. The caulking is applied at a plurality of positions corresponding to cut-out portions 232*c* and 235*c* of the rings 232, 235 so that the metal of front end plate 11 or circular end plate 221 is moved into cut-out portions 232*c*, 235*c*. Thus, the rings 232, 235 are more securely attached to the front end plate 11 and circular end plate 221, and the caulked portions receive the radial component and tangential component of the rotation-preventing force. In this construction, the force acting on the pins is thereby also reduced.

This invention has been described in detail in connection with preferred embodiments, which are only for exemplification, and the invention is not restricted thereto. It will be easily understood by those skilled in the art that other variations or modifications can be easily made within the scope of this invention.

We claim:

1. In an orbiting member fluid displacement apparatus including a housing, a fixed fluid displacement member attached to or integral with said housing, an orbiting member having an end plate from which an orbiting fluid displacement member extends, said fixed and orbiting fluid displacement members interfitting at a radial offset to make a line contact to separate a fluid outlet from a fluid inlet, a driving mechanism including a rotatable drive shaft connected to said orbiting member to drive said orbiting member in a orbital motion, rotation-preventing/thrust-bearing means connected to said orbiting member for preventing the rotation of said orbiting member and for carrying axial thrust load from said orbital member during orbital motion so that the line contact moves toward a discharge opening, said rotation-preventing/thrust-bearing means being comprised of a discrete orbital portion, a discrete fixed portion and bearing elements coupled between said portions, said orbital portion including an orbital annular race and an orbital ring placed within an annular groove formed in said end plate on an opposite side from which said orbiting fluid displacement member extends and fixed therein by a fasting device, said orbital ring having a plurality of first pockets extending axially toward said orbital race and being fixed to said orbiting fluid displacement member by caulking applied to an outer peripheral edge of said annular groove in said orbiting fluid displacement member, said fixed portion including a fixed annular race and a fixed ring placed within an annular groove formed in said housing and fixed therein by a fasting device, said fixed ring having a plurality of second pockets extending axially toward said fixed race and being fixed to said housing by caulking applied to an inner peripheral edge of said annular groove in said housing, said bearing elements each being carried within generally aligned pairs of said first and second pockets and contacting said orbital and fixed races to prevent the rotation of said orbiting member by said bearing elements interacting with said orbital and fixed rings and to carry the axial thrust load from said orbiting member on said fixed race through said bearing elements.

2. In a scroll-type fluid displacement apparatus including a housing, a fixed scroll attached to said housing and having a first end plate from which a first wrap extends into said housing, an orbiting scroll having a second end plate from which a second wrap extends, said first and second wraps interfitting at an angular and radial offset to make a plurality of line contacts to define at least one pair of sealed-off fluid pockets, and a driving mechanism including a rotatable drive shaft connected to said orbiting scroll to drive said orbiting scroll in an orbital motion, rotation-preventing/thrust-bearing means connected to said orbiting scroll for preventing the rotation of said orbiting scroll and for carrying axial thrust load from said orbital scroll during orbital motion so that the volume of said fluid pockets change, said rotation-preventing/thrust-bearing means being comprised of a discrete orbital portion, a discrete fixed portion and bearing elements coupled between said portions, said orbital portion including a separately formed orbital annular race and orbital ring placed within an annular groove formed in said second end plate on an opposite side from which said second wrap extends and being fixed therein by pins, said orbital ring having a plurality of first pockets extending axially toward said orbital race and being fixed in said annular groove by caulking applied to an outer peripheral edge of said annular groove in said second end plate, said fixed portion including a separately formed fixed annular race and fixed ring placed within an annular groove formed in said housing and being fixed therein by pins, and fixed ring having a plurality of second pockets extending axially toward said fixed race and being fixed in said annular groove formed in said housing by caulking applied to an inner peripheral edge of said last-mentioned groove, said bearing elements each being carried within generally aligned pairs of said first and second pockets and contacting said orbital and fixed races to prevent the rotation of said orbiting scroll by said bearing elements interacting with said orbital and fixed rings and to carry the axial thrust load from said orbiting scroll on said fixed race through said bearing elements.

3. The scroll-type fluid displacement apparatus of claim 2, wherein said orbital ring and fixed ring each have a beveled portion at their peripheral surfaces facing said respective caulked peripheral edges, said caulked peripheral edges being deformed into overlapping relationship with said beveled portions.

4. The scroll-type fluid displacement apparatus of claim 2, wherein said orbital ring and fixed ring each have a plurality of cut-out portions at their peripheral surfaces facing said respective caulked peripheral edges, said caulked peripheral edges being deformed into said cut-out portions.

5. A scroll-type fluid displacement apparatus comprising:

a housing having a front end plate;

a fixed scroll attached to said housing and having a first end plate from which a first wrap extends into an interior of said housing;

an orbiting scroll having a second circular end plate from which a second wrap extends, and said first and second wraps interfitting an an angular and radial offset to make a plurality of line contacts to define at least one pair of sealed-off fluid pockets;

a driving device operatively connected to said orbiting scroll to drive said orbiting scroll in orbital motion;

rotation-preventing/thrust-bearing means connected to said orbiting scroll for preventing the rotation of said orbiting scroll and for carrying the axial thrust of said orbiting scroll during its orbital motion; and said rotation-preventing/thrust-bearing means comprising a discrete orbital portion, a discrete fixed portion and bearing elements, said orbital portion including an orbital annular race and an orbital ring both of which are formed separately, said orbital annular race and ring being placed within an annular groove formed in an end surface of said second end plate on an opposite side from which said second wrap extends and being fixed therein by pins, said orbital ring having a plurality of pockets extending in an axial direction toward said orbital race and being fixed in said annular groove by caulking applied to a peripheral edge of said annular groove, said fixed portion including fixed annular race and a fixed ring both of which are formed separately, said fixed annular race and ring being placed within an annular groove formed in an inner surface of said housing, said fixed ring having a plurality of pockets extending an axial direction toward said fixed race and being fixed in said last-mentioned groove by caulking applied to a peripheral edge of said last-mentioned annular groove, said pockets of said orbital and fixed rings facing one another in generally aligned pairs and having corresponding size, pitch and radial distance, said bearing elements each being carried within one of said generally aligned pairs of pockets and contacting said orbital and fixed races to prevent the rotation of said orbiting scroll by said bearing elements interacting with said orbital and fixed rings and to carry the axial thrust load from said orbiting scroll on said fixed race through said bearing elements.

6. The scroll-type fluid displacement apparatus of claim 5, wherein said orbital ring and fixed ring each have a beveled portion at their peripheral surfaces facing said respective caulked peripheral edges, said caulked peripheral edges being deformed into overlapping relationship with said beveled portions.

7. The scroll-type fluid displacement apparatus of claim 5, wherein said orbital ring and fixed ring each have a plurality of cut-out portions at their peripheral surfaces facing said respective caulked peripheral edges, said caulked peripheral edges being deformed into said cut-out portions.

* * * * *